US008887541B2

(12) United States Patent
Zhang et al.

(10) Patent No.: US 8,887,541 B2
(45) Date of Patent: Nov. 18, 2014

(54) SECURITY DEVICE

(75) Inventors: Ningsheng Zhang, Charlotte, NC (US); Brian V. Conti, Matthews, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 75 days.

(21) Appl. No.: 12/723,326

(22) Filed: Mar. 12, 2010

(65) Prior Publication Data

US 2011/0219828 A1 Sep. 15, 2011

(51) Int. Cl.
*E05B 65/00* (2006.01)
*E05B 73/00* (2006.01)

(52) U.S. Cl.
CPC ..... *E05B 73/0017* (2013.01); *Y10S 70/09* (2013.01); *Y10S 70/20* (2013.01)
USPC ..... 70/57.1; 70/63; 70/169; 70/173; 70/276; 70/DIG. 9; 70/DIG. 20; 206/1.5; 340/572.9

(58) Field of Classification Search
USPC ..... 70/57.1, 19, 63, DIG. 9, DIG. 20, 276, 70/413, 57, 58, 77, 158, 163, 165–173, 70/DIG. 8, 27; 292/179, 180, 251.5, 292/DIG. 11, DIG. 37; 206/0.6, 0.7, 1.5, 206/807; 215/215, 207, 219–221, 272, 302; 220/210, 284; 340/572.1, 572.8, 572.9, 340/568.1
See application file for complete search history.

(56) References Cited

U.S. PATENT DOCUMENTS 2,554,306 A * 5/1951 Mack ..... 280/438.1
2,630,699 A * 3/1953 Langdon ..... 70/232
3,386,274 A * 6/1968 McIntyre ..... 70/232
3,706,211 A * 12/1972 Owen ..... 70/232
3,744,284 A * 7/1973 Waldenstrom ..... 70/232
3,792,884 A * 2/1974 Tutikawa ..... 292/37
3,851,505 A * 12/1974 Wilkinson ..... 70/255
3,908,942 A * 9/1975 Keith et al. ..... 248/158

(Continued)

FOREIGN PATENT DOCUMENTS

| | | |
|---|---|---|
| FR | 2735751 | 12/1996 |
| WO | WO 01/75254 A1 | 10/2001 |
| WO | WO 2006/033123 A1 | 3/2006 |
| WO | WO 2008/075310 A2 | 6/2008 |

OTHER PUBLICATIONS

International Search Report and Written Opinion for International Application No. PCT/US2011/027799, mailed Jul. 21, 2011.

*Primary Examiner* — Lloyd Gall
(74) *Attorney, Agent, or Firm* — Nathaniel T. Quirk

(57) ABSTRACT

A security may include a base that defines an aperture or opening configured for receiving at least a portion of an object to be secured. The base may support a capture member that is configured to move between a capture position and a release position. The security device may further include a driving member that is configured to move between a first position and a second position and may engage the capture member. When the driving member is moved from the first position to the second position it may urge the capture member from the release position to the capture position. The capture member may be configured to secure the object within the aperture when the capture member is in the capture position. The security device may further comprise a locking member may be configured to releasably engage the driving member to prevent movement of the driving member from the second position to the first position.

21 Claims, 13 Drawing Sheets

(56) References Cited

U.S. PATENT DOCUMENTS

| | | | | |
|---|---|---|---|---|
| 4,132,093 | A * | 1/1979 | McDorman, Sr. | 70/231 |
| 4,565,078 | A * | 1/1986 | Solomon | 70/95 |
| 4,620,718 | A * | 11/1986 | Mickelson | 280/507 |
| 4,882,921 | A * | 11/1989 | Wopinski | 70/232 |
| 5,602,530 | A * | 2/1997 | Holmgren | 340/572.1 |
| 5,714,807 | A * | 2/1998 | Albanes | 307/10.2 |
| 5,760,689 | A * | 6/1998 | Holmgren | 340/568.8 |
| 5,957,313 | A * | 9/1999 | Bouan | 215/215 |
| 5,979,196 | A * | 11/1999 | Vanmoor | 70/57.1 |
| 6,161,402 | A * | 12/2000 | Moore | 70/14 |
| 6,442,983 | B1 * | 9/2002 | Thomas et al. | 70/38 A |
| 6,449,991 | B1 * | 9/2002 | Hogan | 70/57.1 |
| 6,755,055 | B2 * | 6/2004 | Sedon et al. | 70/57.1 |
| 6,761,050 | B2 * | 7/2004 | Rosenberg | 70/14 |
| 6,848,282 | B2 * | 2/2005 | Palzkill et al. | 70/14 |
| 7,350,654 | B2 * | 4/2008 | Belden, Jr. | 215/215 |
| 7,403,118 | B2 * | 7/2008 | Belden, Jr. | 340/568.2 |
| 7,650,768 | B2 * | 1/2010 | Fawcett et al. | 70/58 |
| 7,984,629 | B2 * | 7/2011 | Xiaobin | 70/57 |
| 8,011,214 | B2 * | 9/2011 | Katagiri et al. | 70/252 |
| 8,294,583 | B2 * | 10/2012 | Sayegh et al. | 340/572.9 |
| 8,368,537 | B2 * | 2/2013 | Zhang et al. | 340/568.1 |
| 8,525,675 | B2 * | 9/2013 | Zhang et al. | 340/568.1 |
| 2004/0163430 | A1 | 8/2004 | Belden, Jr. | |
| 2005/0017865 | A1 | 1/2005 | Belden, Jr. | |
| 2005/0237205 | A1 | 10/2005 | Gorst | |
| 2006/0021394 | A1 * | 2/2006 | Belden, Jr. | 70/57.1 |
| 2006/0070410 | A1 * | 4/2006 | Fuss et al. | 70/57.1 |
| 2006/0170559 | A1 | 8/2006 | Marsilio et al. | |
| 2006/0283216 | A1 * | 12/2006 | Marcelle et al. | 70/38 A |
| 2007/0271970 | A1 * | 11/2007 | Marsilio et al. | 70/57.1 |
| 2008/0034815 | A1 * | 2/2008 | Fawcett et al. | 70/57.1 |
| 2008/0100418 | A1 * | 5/2008 | Stobbe et al. | 340/5.73 |
| 2009/0152230 | A1 | 6/2009 | Belden, Jr. | |
| 2010/0287998 | A1 * | 11/2010 | Anderson et al. | 70/57.1 |
| 2012/0151974 | A1 * | 6/2012 | Zhang et al. | 70/63 |

* cited by examiner

SECURITY DEVICE

TECHNOLOGICAL FIELD

The present invention relates to security devices used to protect merchandise or other objects and, more particularly, to security devices configured for attachment to articles having a non-uniform and/or irregular shape, such as a bottle.

BACKGROUND

Electronic article surveillance (EAS) systems are often used to deter and detect shoplifting. In most EAS systems, it is the EAS tag that is detected and not the retail product itself. Therefore, many EAS systems can be circumvented by removing the EAS tag from the retail product or disabling the EAS tag. Security devices are used to prevent EAS tags from being removed, or tampered with, by unauthorized persons.

Applicant has identified a number of deficiencies and problems associated with the design and operation of conventional security devices. Through applied effort, ingenuity, and innovation, Applicant has solved many of these identified problems by developing a solution that is embodied by the present invention, which is described in detail below.

BRIEF SUMMARY

Various embodiments of the present invention are directed a security device that may reduce or discourage retail theft and has an easy to use, aesthetically pleasing appearance. The security device may be attached to a variety of types of articles of merchandise, but may often be configured for attachment to an end or a top portion of an article.

Security devices according to example embodiments of the present invention may include a base that defines an aperture or opening configured for receiving at least a portion of an object to be secured. The base may support a capture member that is configured to move between a capture position and a release position. The security device may further include a driving member that is configured to move between a first position and a second position and may engage the capture member. When the driving member is moved from the first position to the second position it may urge the capture member from the release position to the capture position. The capture member may be configured to secure the object within the aperture when the capture member is in the capture position. The security device may further comprise a locking member that may be configured to releasably engage the driving member to prevent movement of the driving member from the second position to the first position.

In some embodiments, the locking member may be a locking spring that is configured to engage a locking surface of the driving member. The locking member may be disengaged from the locking surface of the driving member by applying of a magnetic key to the locking member.

Security devices according to example embodiments of the present invention may be configured to receive a top portion of the object through the aperture when the capture member is in the release position. The capture member of the security device may be configured to prevent removal of the top portion from the security device when the capture member is in the capture position.

Further embodiments of the present invention may include a security element, such as an electronic article surveillance (EAS) device. The security element may be configured in an active state and an inactive state, where the security element is in the active state when the capture member is in the capture position, and where the security element is in the inactive state when the capture member is in the release position.

The driving member of example embodiments may be biased in the first position and/or the capture member of example embodiments may be biased in the release position. When the driving member is moved from the first position to the second position along a first axis, the capture member may be driven from the release position to the capture position along a second axis that is substantially perpendicular to the first axis.

Security devices according to example embodiments of the present invention may include a base that defines an aperture that is configured for receiving at least a portion of an object to be secured by the security device. The security device may also include a capture member that is supported by the base, wherein the capture member is configured to move between a release position and a capture position. The capture member may be configured to secure the object within the aperture when the capture member is in the capture position. The security device may further comprise a locking member configured to engage the capture member and prevent movement of the capture member from the capture position to the release position when the locking member is engaged.

In some embodiments, the locking member may be a locking spring that is configured to engage a locking surface of the capture member. The locking member may be disengaged from the locking surface of the capture member by applying a magnetic key to the locking member. The capture member may further be biased in the release position by a biasing element such that application of the magnetic key causes the capture member to be driven to the release position.

Security devices according to example embodiments of the present invention may be configured to receive a top portion of the object through the aperture when the capture member is in the release position. The capture member of the security device may be configured to prevent removal of the top portion from the security device when the capture member is in the capture position. The capture member may be biased in the release position.

Further embodiments of the present invention may include a security element, such as an electronic article surveillance (EAS) device. The security element may be configured in an active state and an inactive state, where the security element is in the active state when the capture member is in the capture position, and where the security element is in the inactive state when the capture member is in the release position.

BRIEF DESCRIPTION OF THE SEVERAL VIEWS OF THE DRAWING(S)

Reference will now be made to the accompanying drawings, which are not necessarily drawn to scale, and wherein.

DETAILED DESCRIPTION

The present invention will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. The terms top, bottom, side, up, down, upwards, downwards, vertical, horizontal, and the like as used below do not imply a required limitation in all embodiments of the present invention but rather are used herein to help describe relative direction or orientation in the exemplary embodiment illustrated in the figures.

Various embodiments of the present invention provide a security device configured for attachment to a retail product or other object. In some embodiments, for example, as shown in FIG. 1, the security device 100 may be configured for attachment to a retail product, such as the depicted bottle 50. The security device 100 may include an electronic article surveillance (EAS) element or other similar device (e.g., an RFID transponder, etc.) that may be used to detect and deter unauthorized removal of the security device 100 from a particular area such as a retail store.

Figure 1A:
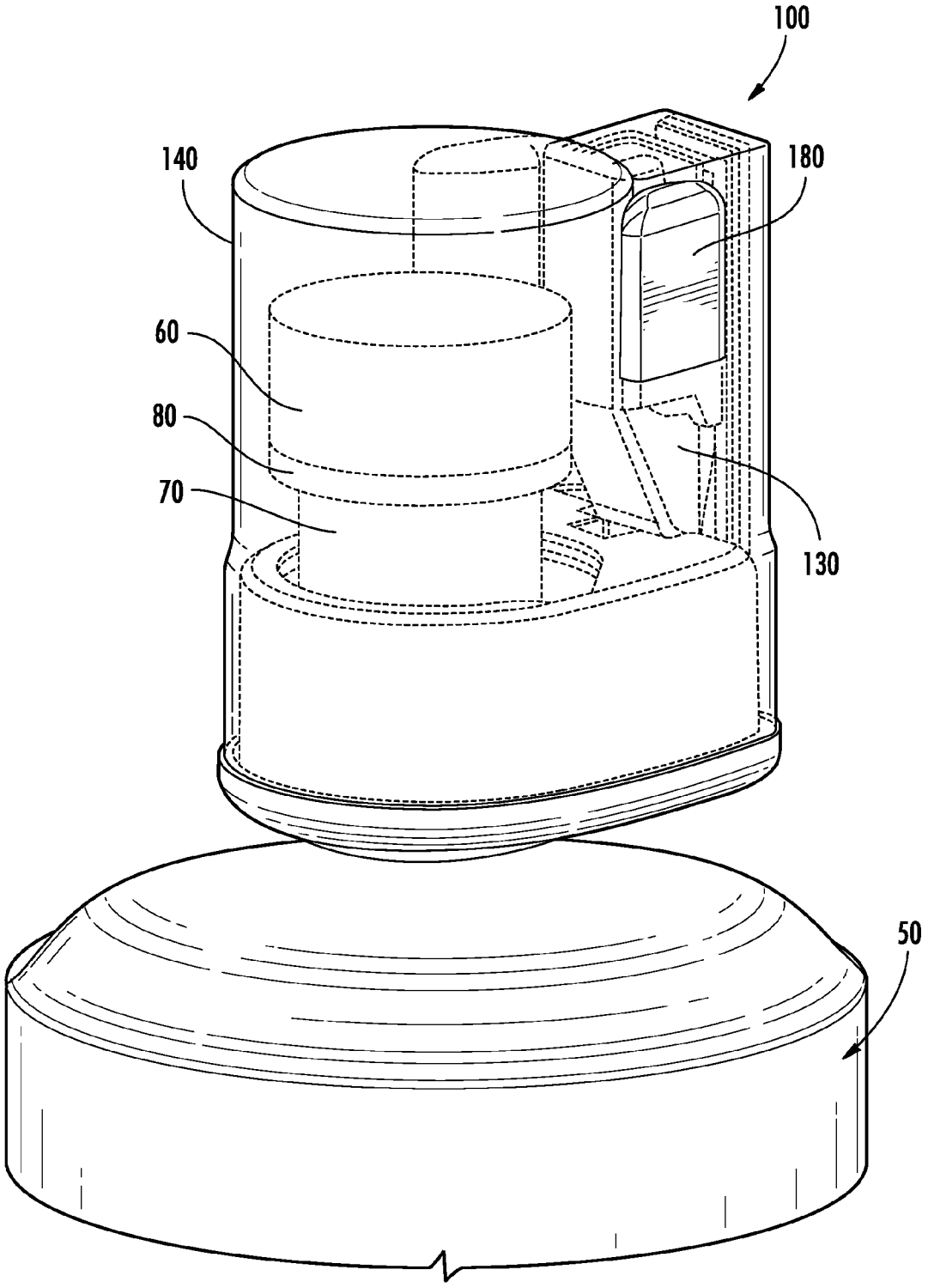
FIG. 1A is an illustration of a security device attached to an article of merchandise according to an example embodiment of the present invention.
Figure 1B:
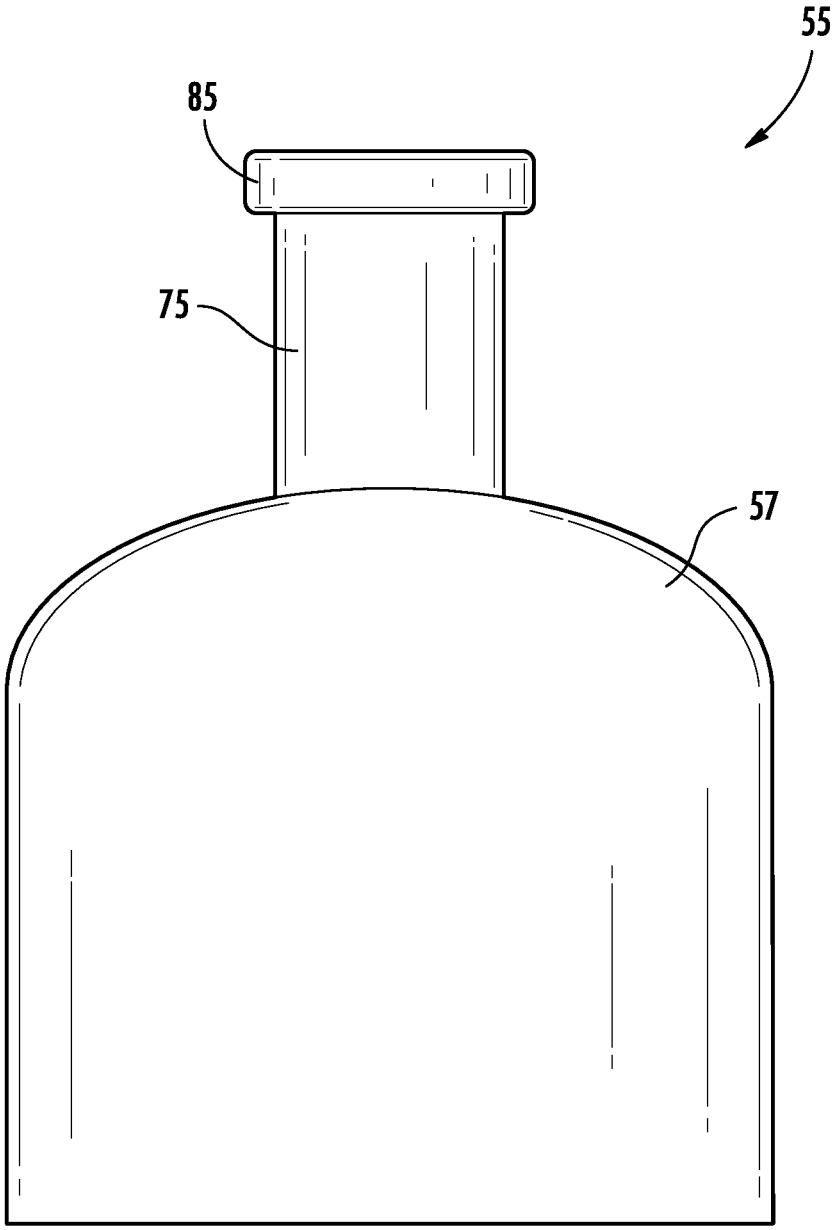
FIG. 1B is an illustration of an example embodiment of an object that may be secured by security devices according to example embodiments of the present invention.

For illustration purposes the forgoing description refers to security devices adapted to secure bottles such as the exemplary bottle 50 depicted in FIG. 1A, which includes a top portion 60 comprising a flange 80 defining a first diameter and a neck portion 70 disposed below the top portion 60 defining a second diameter that is smaller than the first diameter. An example embodiment of a bottle that may be secured by a device according to embodiments of the present invention is illustrated in FIG. 1B which depicts a bottle 55 comprising a top portion 85 and a neck portion 75 disposed between the top portion 85 and the body of the bottle 57. The neck portion 75 is of a smaller diameter than the top portion 85. The bottle depicted in FIG. 1B is of a configuration similar to a common wine bottle where the top portion and the flange portion 85 are one-in-the-same. Security devices structured in accordance with various embodiments of the invention are not, however, limited to use in securing bottles. Indeed, such devices may be used to secure a variety of retail products so long as such products have an elongate portion that defines differing diameters or perhaps a flanged end.

The term diameter may be used to refer to various shapes, for example a bottle that includes a neck portion of a hexagonal shape and a top portion of a square shape, or a neck portion of a circular shape and a top portion of a triangular shape. Articles that may include a flange may be a wine bottle or the handle-end of a baseball bat among others.

Figure 2:
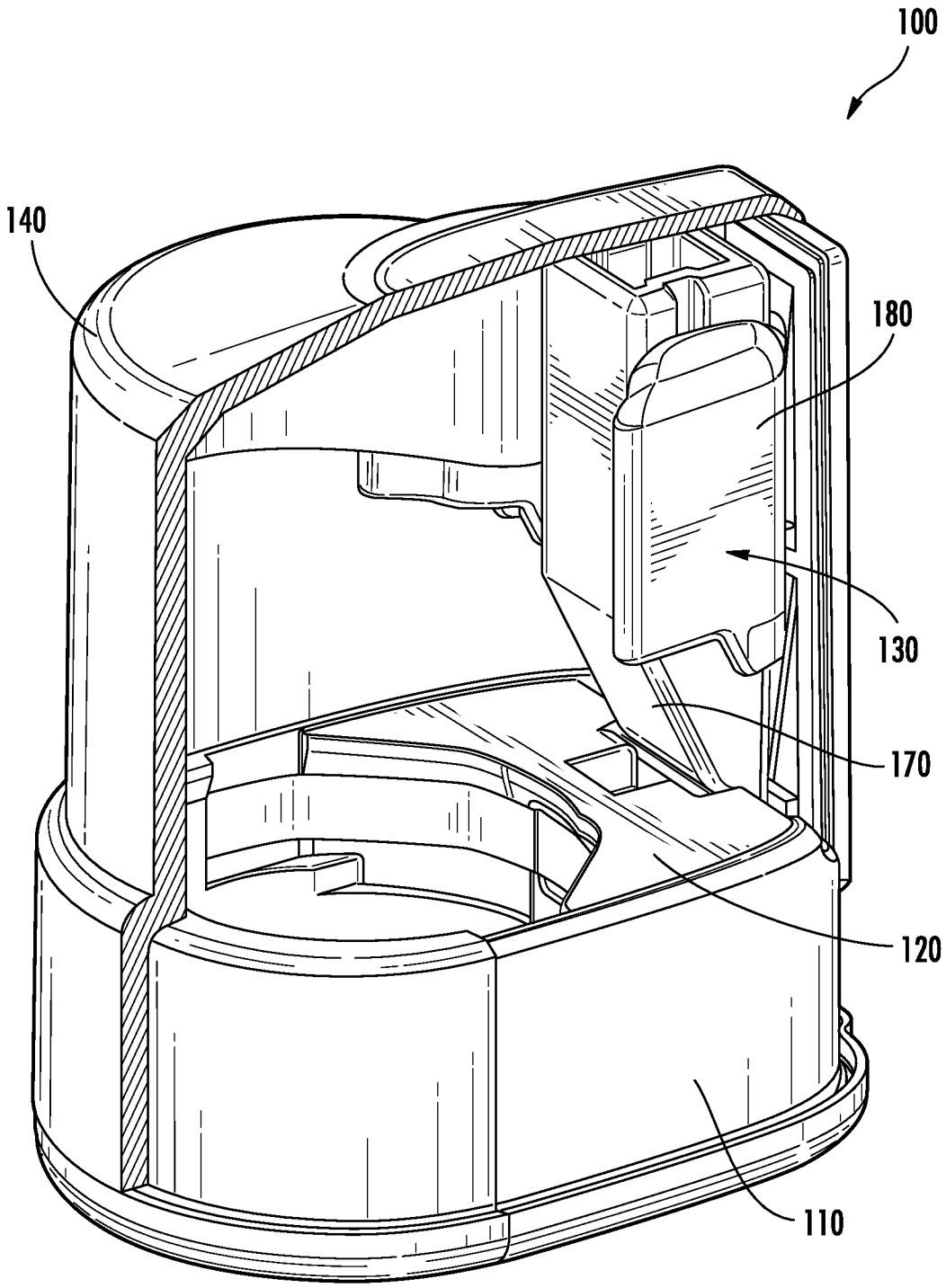
FIG. 2 is a cut-away view of a security device according to an example embodiment of the present invention.

FIG. 2 is a cut-away view of the security device 100 shown in FIG. 1. The depicted security device 100 includes a base 110, a capture member 120 that is at least partially retained by the base 110, and a driving member 130 comprising a button portion 180 that is configured for actuation by a user to drive the capture member 120 from a release position, as shown in FIG. 2 (i.e., where the security device is removable from an article), to a capture position (i.e., where the security device may be fastened to an article).

The depicted security device 100 includes a cover or housing portion 140 that enhances the aesthetic appeal of the security device while also protecting internal components of the security device 100 from manipulation or tampering by would-be thieves. The housing portion 140 further inhibits removal of a bottle cap, cork, stopper, and the like, when the security device is fastened to the bottle 50, thus preventing removal of, or tampering with the contents of the bottle 50.

The base 110 and the housing portion 140 may each be made of a durable plastic material that resists breakage such as high density polyethylene (HDPE), acrylonitrile butadiene styrene (ABS), or polycarbonate among others. In one embodiment, the base 110 and housing portion 140 may be constructed of a material that is at least strong enough to withstand an impact having a force sufficient to break the bottle (e.g., a glass bottle) to which the security device is attached. In this regard, the security device 100 may provide a benefit-denial type of functionality.

The housing portion 140 may be attached to the base 110 by an adhesive, a fastener, or, in one preferred embodiment, through ultrasonic welding. The attachment may be substantially permanent to prevent a would-be thief from removing the housing portion 140. The housing portion 140 may be made from a transparent or semi-transparent material (e.g., polycarbonate) for aesthetics. In one embodiment, such transparent housing portions may permit a user to see that a retail product is properly secured within the security device.

Figure 3A:
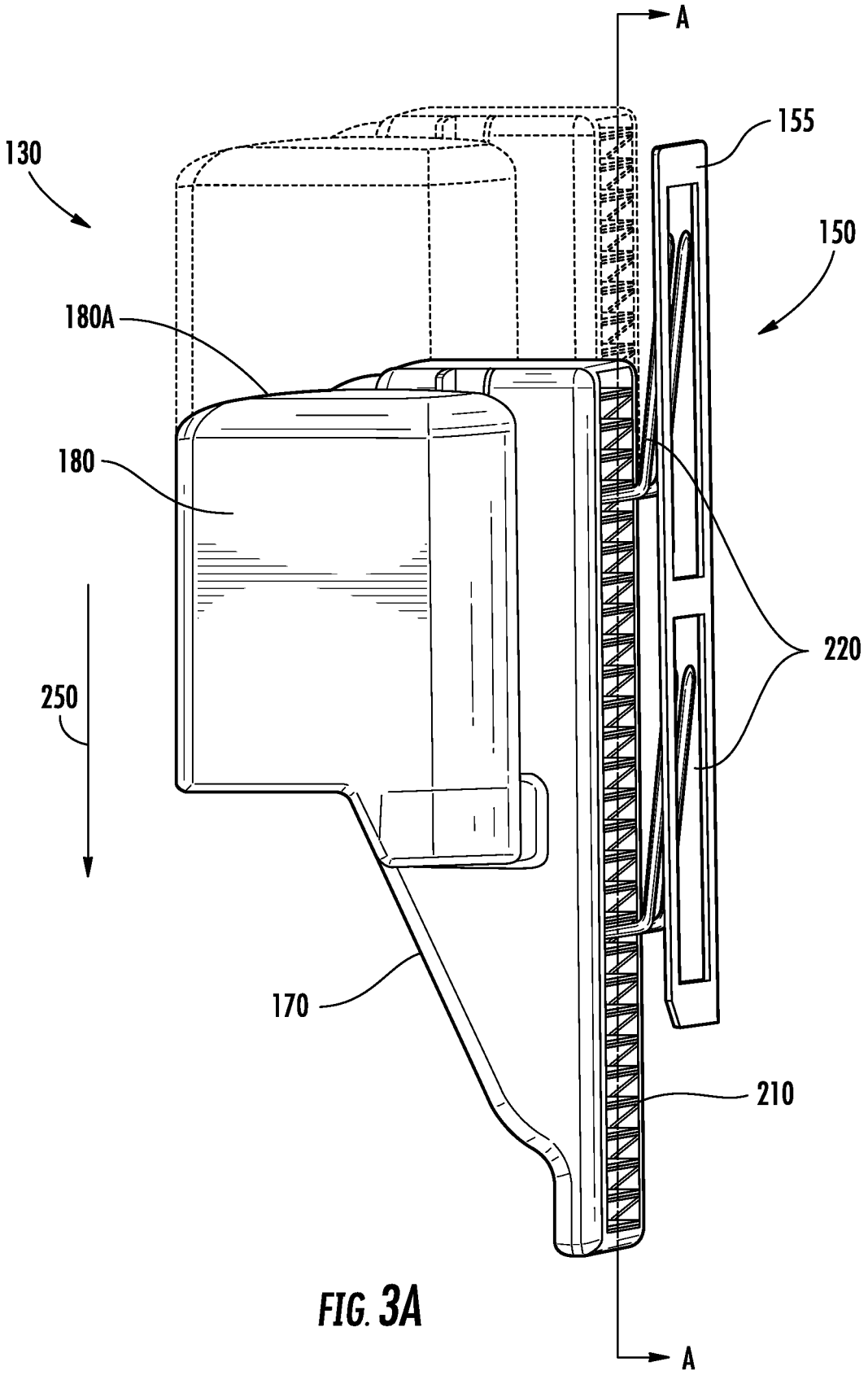
FIG. 3A is an illustration of a locking spring engaged with a driving member according to an example embodiment of the present invention.
Figure 3B:
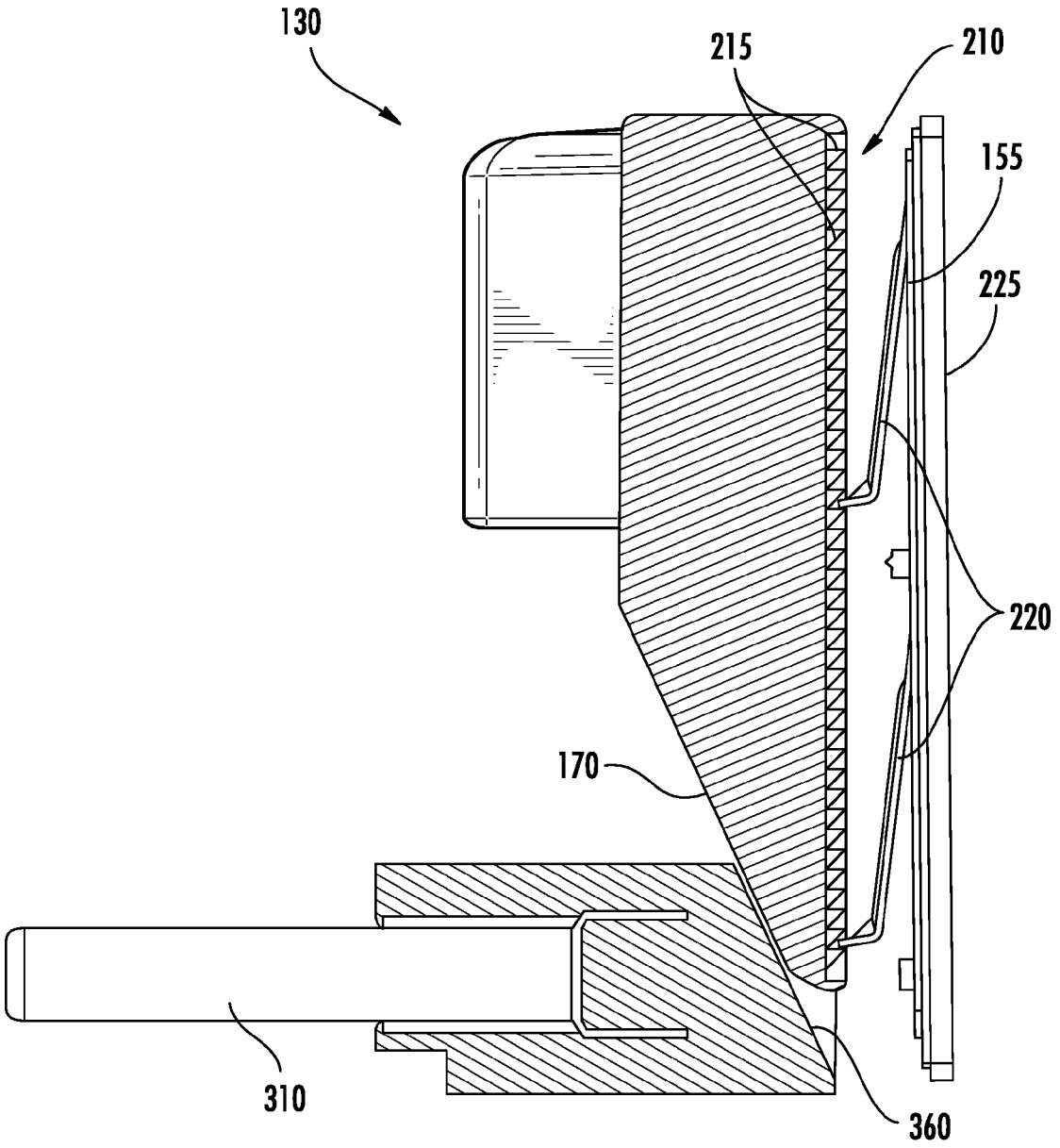
FIG. 3B is a section view taken along section line A-A of the locking spring and driving member of FIG. 3A.

FIGS. 3A and 3B are detail and section views, respectively, illustrating a driving member 130 having a locking surface 210, a button portion 180, and a cam surface 170. The button portion 180 defines a pressing surface 180A that is configured to be pressed by a user when locking the security device 100 in the direction of arrow 250. The driving member 130 is generally supported by the housing 140, the base 110, and the capture member 120 as illustrated in FIG. 2. As a result, in various embodiments, the housing portion 140 may define an opening through which a user may access the pressing surface 180A of the button portion 180. In one embodiment, the button portion 180 extends at least partially through an opening in the housing portion 140 such that the button portion 180 is accessible in unlocked and locked positions, i.e., a first position as shown in FIG. 2 where the security device is removable from the article and a second position where the security device may be securely fastened to the article.

Referring back to FIGS. 3A and 3B, a locking member 150 may be configured to releasably engage the locking surface 210 of the driving member 130. The locking member 150 may be configured to be supported by a backing plate 225 that is supported by the housing, or the locking member may be directly supported by the housing. A backing plate 225 may provide additional resiliency to the locking member 150, thus providing additional tamper resistance. In the depicted embodiment, when the locking member 150 is engaged with the locking surface 210, movement of the driving member 130 from the first position (i.e., an unlocked position) to the second position (i.e., a locked position) along movement arrow 250 is possible, while movement from the second position to the first position is prohibited. When the locking member 150 is disengaged from the locking surface 210 of the driving member 130, movement in either direction may be possible. FIG. 3A depicts the driven member 130 in dashed lines when disposed in the first position and in solid lines when disposed in the second position for illustration purposes.

The locking member 150 may be embodied in a number of configurations including a locking spring as shown. The depicted locking spring includes a substantially flat portion 155 and two angled portions 220. The angled portions of the illustrated embodiment are biased to extend away from the substantially flat portion 155 and are thereby configured to releasably engage the locking surface 210 of the driving member 130. The depicted locking spring is formed from a ferromagnetic material. The angled portions 220 are thus configured to be disengaged, or released from locking surface 210, upon application of a magnetic key as will be described in more detail below.

The depicted locking surface 210 is a ratchet surface that includes a plurality of angled teeth 215. The angled teeth 215 may be configured to permit relative sliding movement between the locking member 150 and the driving member 130 in a first direction (from the first position shown in dashed lines to the second position along arrow 250), while preventing relative sliding movement in the opposite direction. An advantage to the ratchet surface is the ability of the angled portions 220 to engage the locking surface 210 in a plurality of locations thereby providing adjustability to the security device 100 so that it may accommodate different sized articles. As will be apparent to one of skill in the art in view of this disclosure, the first and second positions referred to herein may refer to any two positions along the locking surface 210 depending, at least in part, on the size of the secured article.

Figure 4B:
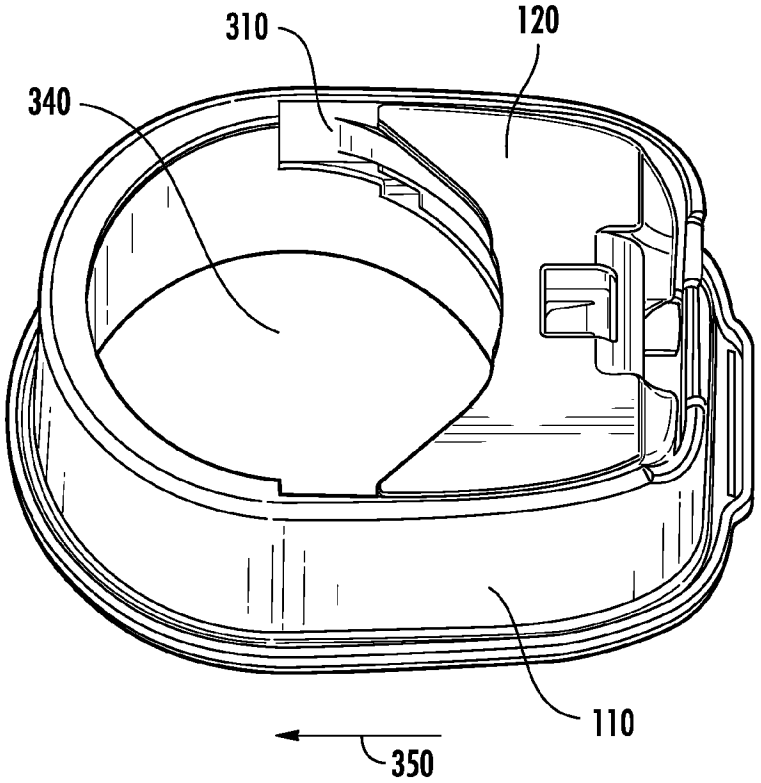
FIG. 4B is an illustration of a base member containing the capture member of FIG. 3B according to an example embodiment of the present invention.
Figure 4A:
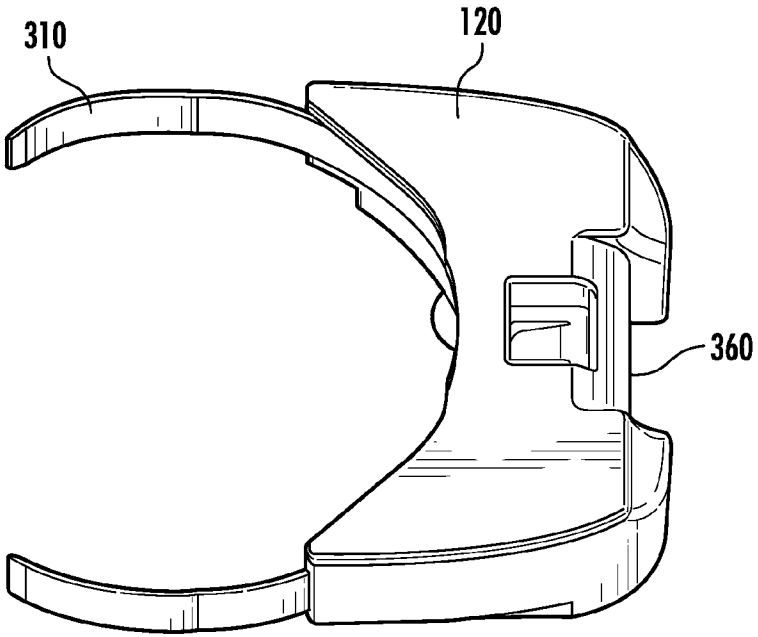
FIG. 4A is an illustration of a capture member according to an example embodiment of the present invention.

FIGS. 4A and 4B illustrate a capture member 120 structured in accordance with one embodiment of the invention. The capture member 120 may be slidably received within the base 110 for movement in the direction of arrow 350 between a release position (shown in FIG. 4B) and a capture position (not shown). The capture member 120 may include a drive surface 360 configured for receiving the cam surface 170 (as shown in FIG. 3) of the driving member 130.

The capture member 120 may further include a resilient member 310 configured to bias the capture member 120 in the release position. For example, in the depicted embodiment, the resilient member 310 is configured to engage the base 110 such that when the capture member 120 is advanced along the direction of arrow 350, i.e., towards the capture position, the resilient member 310 is deformed or deflected inwardly from its original shape by the curvature of the aperture in the base. The deflection or deformation of the resilient member 310 may produce a resultant spring force as the resilient member resists the deflection, thereby biasing the resilient member in the release position.

Figure 5B:
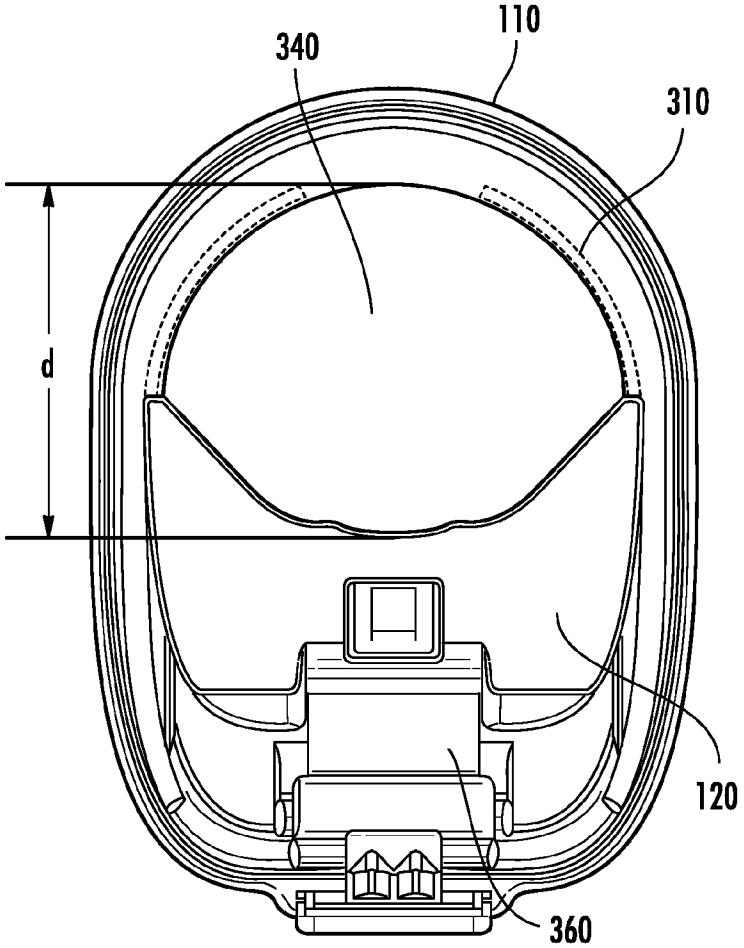
FIG. 5B is an illustration of a security device with the capture member in a capture position according to an example embodiment of the present invention.
Figure 5A:
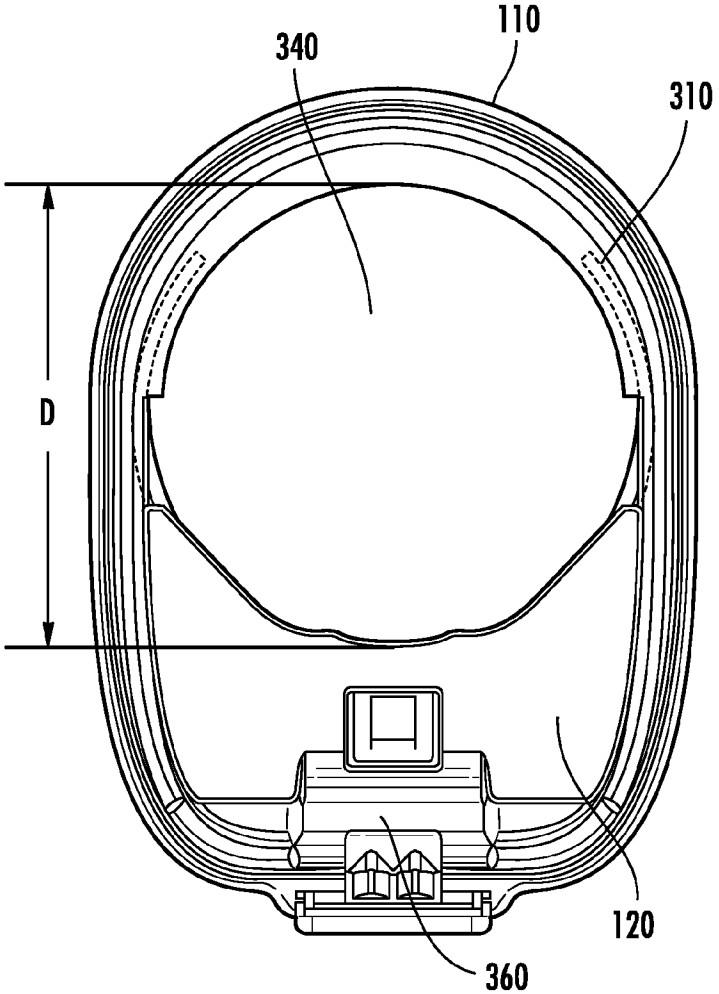
FIG. 5A is an illustration of a security device with the capture member in a release position according to an example embodiment of the present invention.

An example embodiment of the operation of the resilient member is illustrated in FIGS. 5A and 5B. FIG. 5A illustrates an example embodiment of the present invention with the capture member 120 in the release position and the aperture 340 of diameter D. FIG. 5B illustrates the embodiment of FIG. 5A with the capture member 120 advanced to the second position and the resilient member 310 deflected around the curvature of the aperture 340. The aperture 340 of FIG. 5B is of diameter d, which is smaller than diameter D. As the resilient member 310 resists the resultant deflection shown in FIG. 5B, the resilient member 310 biases the capture member 120 towards the release position of FIG. 5A.

Lateral movement of the capture member 120, i.e., movement from a release position to a capture position, may be facilitated by movement of the driving member 130 in accordance with various embodiments of the invention. For example, with reference to the embodiment illustrated by FIGS. 6A-6C, the driving member 130 may be configured to be slidably received by the base 110 such that the driving member 130 is adapted to translate vertically (along arrow 250 of FIG. 3). As the driving member 130 moves from a first position (shown in FIG. 6A) through an intermediate position (shown in FIG. 6B) to a second position (shown in FIG. 6C), the cam surface 170 of the driving member 130 engages the drive surface 360 (shown in FIG. 4A) of the capture member 120. In this regard, the capture member 120 is driven toward the capture position illustrated by FIG. 6C. As will be apparent to one of ordinary skill in the art in view this disclosure, the aperture 340 defined between the base 110 and the capture member 120 is larger when the capture member 120 is disposed in the release position (shown in FIG. 6A) then it is when the capture member 120 is disposed in the capture position (shown in FIG. 6C).

Figure 6C:
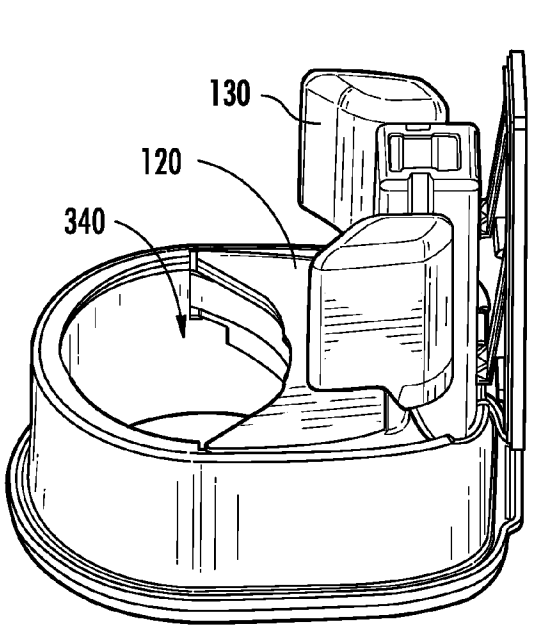
FIG. 6C is an illustration of a security device with the capture member in another capture position according to an example embodiment of the present invention.
Figure 6B:
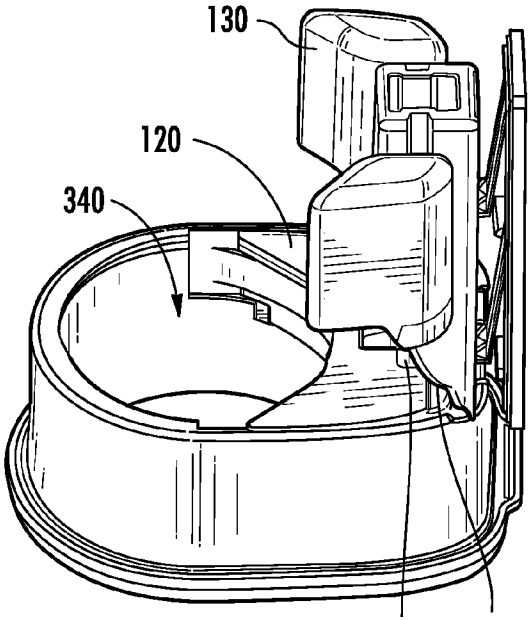
FIG. 6B is an illustration of a security device with the capture member in a capture position according to an example embodiment of the present invention.
Figure 6A:
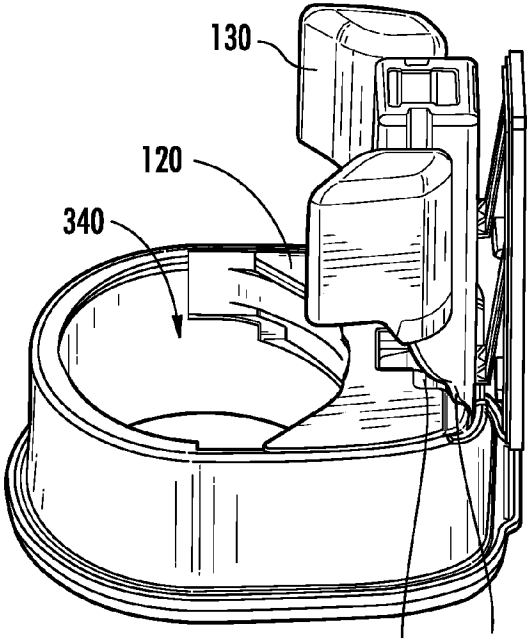
FIG. 6A is an illustration of a security device with the capture member in a release position according to an example embodiment of the present invention.
Figure 7B:
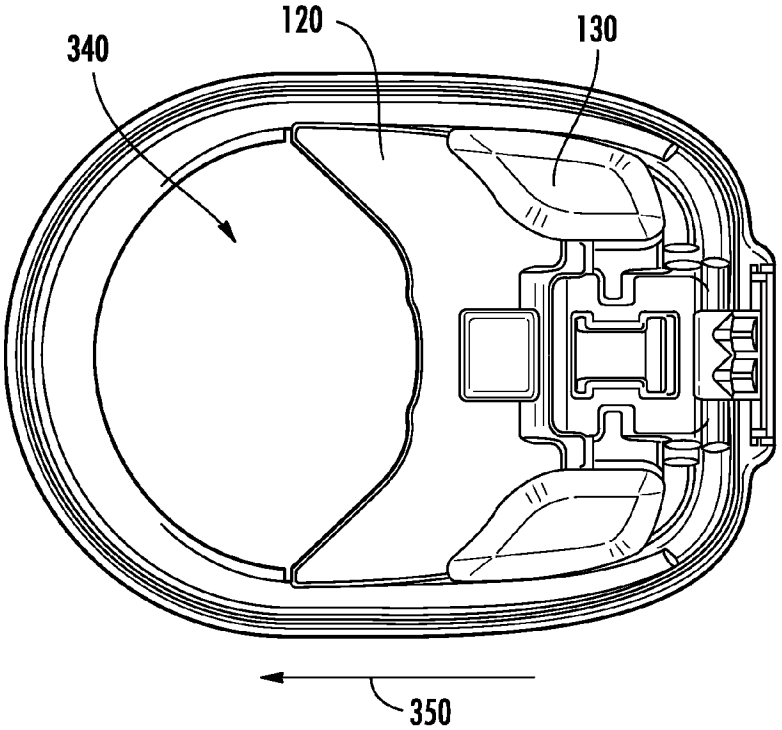
FIG. 7B is an illustration of a security device with the capture member in a capture position according to an example embodiment of the present invention.
Figure 7A:
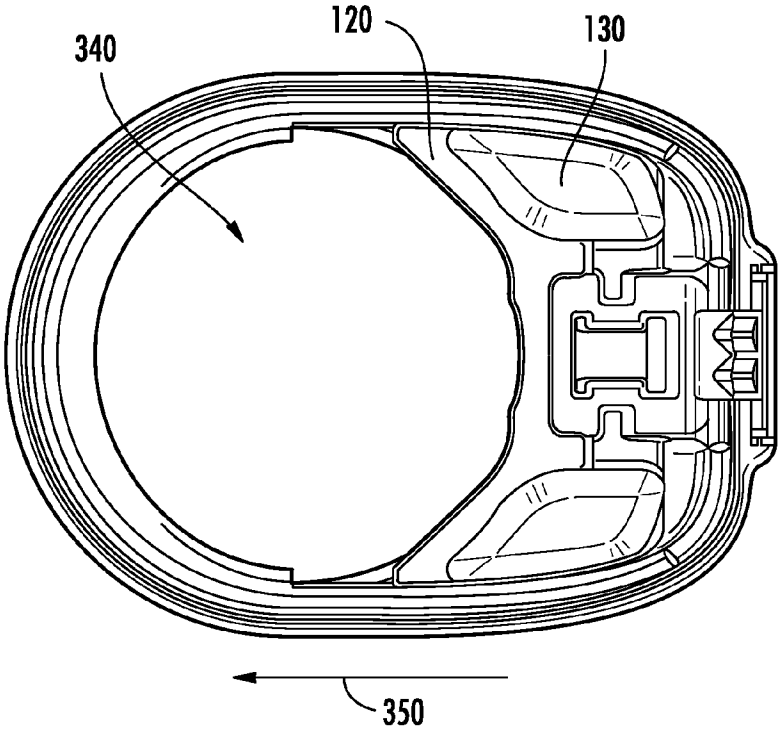
FIG. 7A is an illustration of a security device with the capture member in a release position according to an example embodiment of the present invention.

The size transition of the aperture 340 is also illustrated by FIGS. 7A and 7B, which depict the security device 100 shown in FIGS. 6A-6C from above. FIG. 7A illustrates the security device with the capture member 120 in the release position and the driving member 130 in the first position. As the driving member 130 is advanced from the first position to the second position, the capture member 120 is driven from the release position to the capture position in the direction of the arrow 350. FIG. 7B illustrates the capture member 120 in the capture position and the driving member 130 in the second position. Once again, as was noted above, the aperture 340 is reduced in size when the capture member 120 is driven from the release position to the capture position.

Returning to FIGS. 6A-6C, in some embodiments, the driving member 130 may be biased upwardly (i.e., towards the first position) by a spring or other biasing member (not shown). In some embodiments, for example, a compression spring (not shown) may be configured to resist movement of the driving member 130 toward the second position (as shown in FIGS. 6B and 6C). Optionally, or in addition, the driving member 130 may be biased toward the first position by the bias of the capture member 120. For example, as was noted above, the capture member 120 may be biased toward the release position. The bias of the capture member 120 may be transferred through the drive surface 360/cam surface 170 interface to the driving member 130, as further illustrated in the section view of FIG. 3B, and, thus, operate to urge the driving member 130 toward the first position.

A method for securing the security device to an article will now be discussed with respect to the embodiment of FIGS. 1-7B. With the driving member 130 in the first position and the capture member 120 in the release position, the top portion 60 of an object to be secured 50 is inserted into the aperture 340 of the security device. Once the top portion 60 is disposed within the security device 100 and the neck portion 70 occupies the aperture 340, a user may press on the button surface 180A of the driving member 130. As the button surface 180A is pressed, the driving member 130 advances from the first position to the second position, thereby driving the capture member 120 from the release position to the capture position. The capture member 120 may be advanced by the driving member until the capture member engages the neck portion 70 of the object 50. Upon engagement, the object is secured within the security device and the locking member 150 prevents the driving member 130 from returning to the first position and the driving member 130 thereby prevents the capture member 120 from moving from the capture position to the release position.

In some embodiments, the security device may be released from the above discussed bottle or other article by application of a key (not shown). In one embodiment, the key may be a magnetic key that produces a magnetic field that operates to retract the angled portions 220 of the locking member 150 from the locking surface 210 of the driving member 130. The magnetic key may be applied to the housing portion 140 proximate the locking member 150 such that the angled portions 220 of the locking member are retracted toward the magnetic key and, thus, are disengaged from the locking surface 210. In such embodiments, the biasing element(s) of the capture member 120 and/or the driving member 130 may be configured to return the capture member 120 and the driving member 130 to the release position and first position, respectively, once the locking member 150 has been disengaged by the magnetic key. In alternative embodiments, other key structures may be used as will be readily apparent to those skilled in the art in view of this disclosure.

Figure 8:
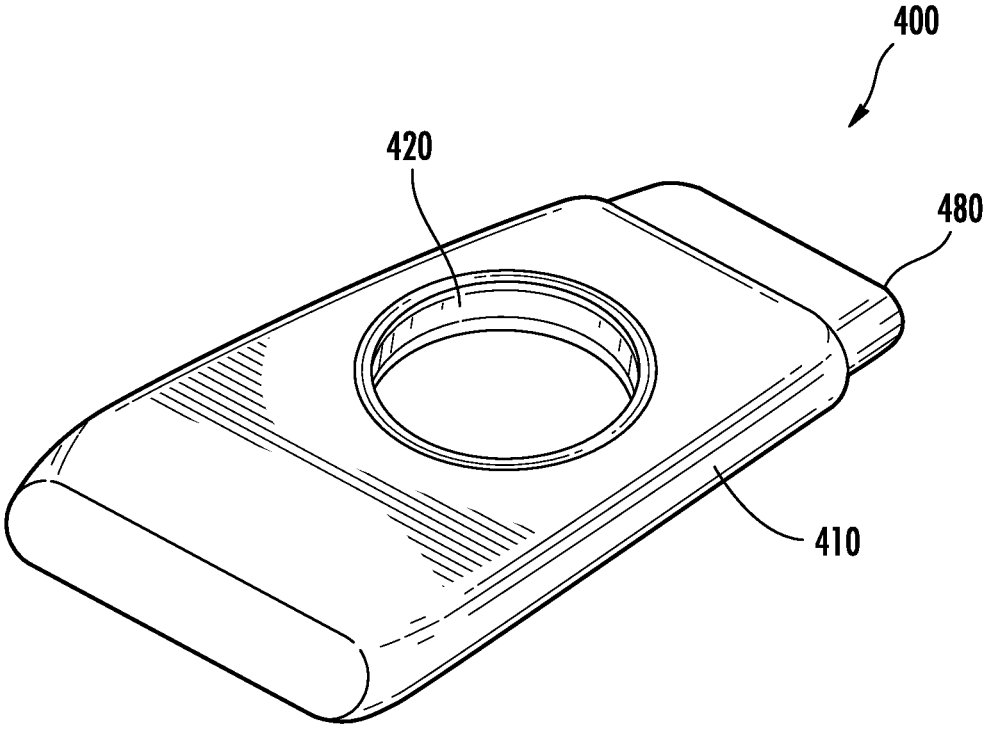
FIG. 8 is a perspective view of a security device according to another example embodiment of the present invention.
Figure 9B:
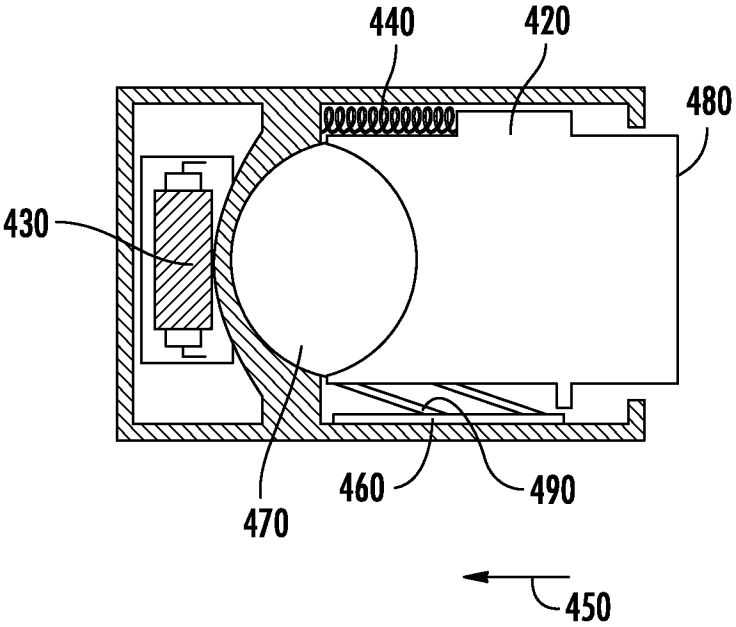
FIG. 9B is a cross-section illustration of the example embodiment of FIG. 8 with the capture member in the capture position.
Figure 9A:
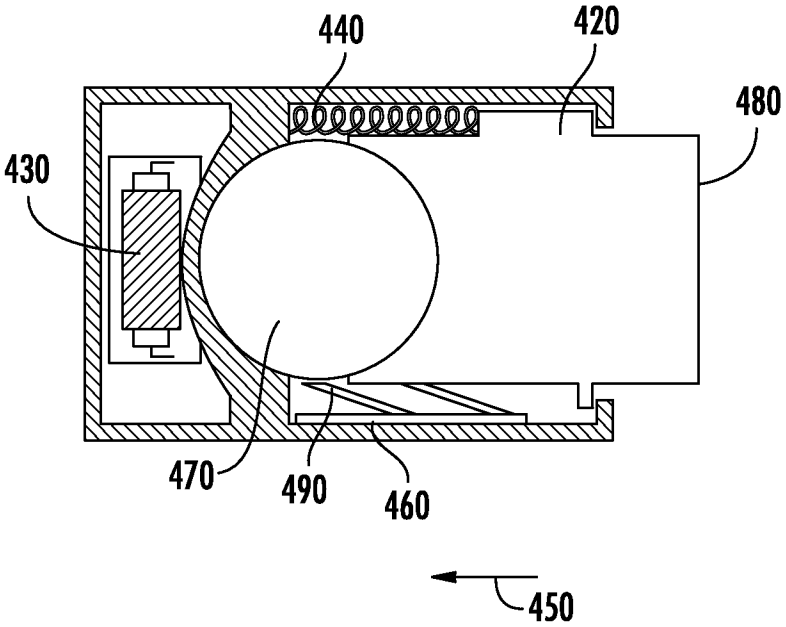
FIG. 9A is a cross-section illustration of the example embodiment of FIG. 8 with the capture member in the release position.

FIG. 8 depicts a security device 400 structured in accordance with another embodiment of the present invention. The depicted security device 400 comprises a base 410, a capture member 420, and a pressing surface 480. FIGS. 9A and 9B illustrate a cross-section of the security device according to the embodiment of FIG. 8. FIG. 9A shows the security device with the capture member 420 in the release position. The capture member 420 may include the pressing surface 480 such that a separate driving member is not required and a user may advance the capture member by pressing on the pressing surface 480 of the capture member. The security device 400 may further comprise a biasing member 440 that may bias the capture member 420 in the release position. While the biasing member 440 is illustrated as a coil spring, it may also be a resilient member as described above with respect to FIG. 4A. The security device 400 may also include a locking element 460, which may be a locking spring with angled portions 490 as illustrated herein and described with respect to FIG. 3 above.

FIG. 9B illustrates the embodiment of FIG. 9A with the capture member 420 in the capture position. A user may press the pressing surface 480 to advance the capture member 420 in the direction of arrow 450, thereby reducing the size of the aperture 470. The locking member 460 may include angled portions 490 that engage a locking surface of the capture member 420. When engaged, the angled portions 490 of the locking member 460 preclude movement of the capture member 420 in the direction of the release position (opposite arrow 450). Application of a key may disengage the angled portions 490 of the locking member 460 from the locking surface of the capture member 420 and allow the biasing element 440 to drive the capture member to the release position.

Figure 10:
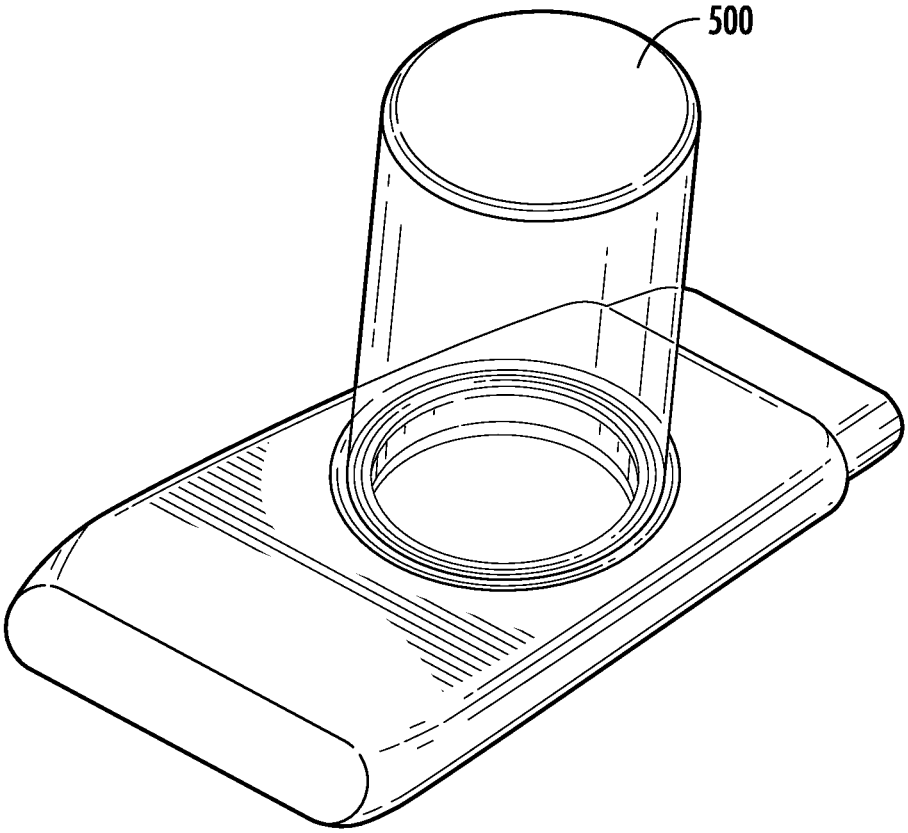
FIG. 10 is perspective view of another example embodiment of the present invention.

FIG. 10 illustrates an example embodiment of the present invention similar to the example embodiments of FIGS. 8, 9A, and 9B; however, the embodiment of FIG. 10 includes a housing portion 500. As noted above, the housing portion of FIG. 10 as well as the housing portion 140 of FIG. 1 prevents tampering with the portion of the article of merchandise that is inserted in to the security device.

Example embodiments of the present invention may be of a variety of sizes for attaching to variety of sizes of articles. A preferred size may be a security device with an aperture of about 1¼ to 2¼ inches in diameter when the capture member is in the release position, and an aperture of about ¾ inch to 2 inches in diameter when the capture member is in the capture position. Such a size may be secured to merchandise with a top portion or flange of at least 1 inch and at most 2¼ inches in diameter and a neck portion size of between ¾ inches and 2 inches, where the top portion or flange diameter is larger than the neck portion diameter. The security device may be scaled to accommodate any size article that includes a top portion of a first diameter and a neck portion of a second diameter which is smaller than the first diameter. The size of the security device housing and base may be proportional to the size of the aperture; however, it is preferable that the overall size of the security device (i.e., the maximum dimension of the base) is no larger than the maximum size of the merchandise (e.g., the largest diameter of a bottle that is to be protected). Such a size would allow a retailer to place articles of merchandise directly adjacent to one another without the security device interfering, minimizing the impact on the retailer's shelf space for seamless integration into an existing retailer's inventory.

Figure 11:
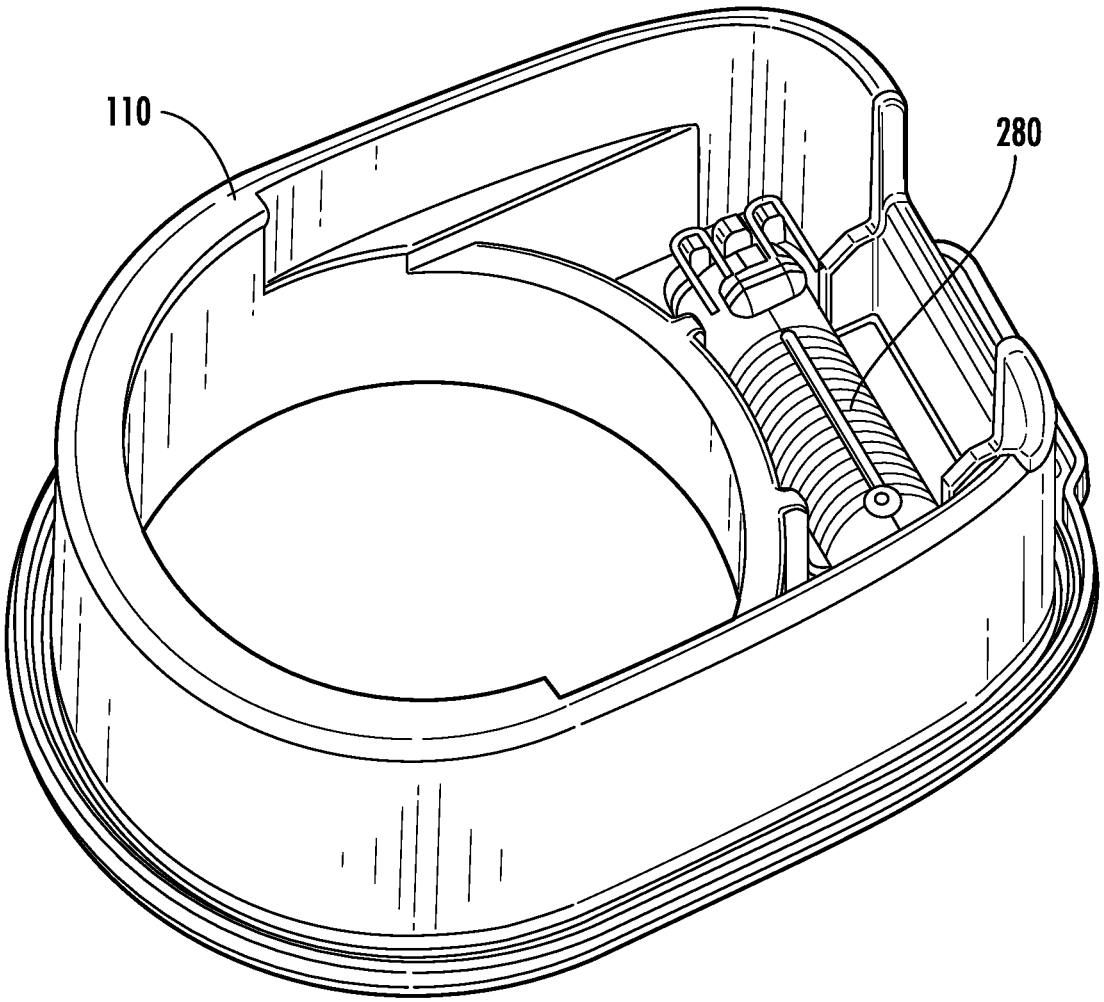
FIG. 11 is a perspective view of a base portion of a security device according to an example embodiment of the present invention.

As indicated above, the security device embodiments disclosed above may include an security element disposed within the housing or the base that is configured to be detectable when the security element is present in a predetermined detection zone, e.g., set up at or near the door or other entrance point of the retail establishment. The security element may include an EAS element or an RFID tag. Security elements may be configured to work within an security system. For example, the security element may a magnetic tag such as in an electromagnetic (EM) system or in an acousto-magnetic (AM) system or an electronic circuit and antenna as in a radio frequency (RF) system. As another example, the security element may be configured work within a microwave system. The security element 280 of the embodiment illustrated in FIGS. 1 through 7B may be enclosed in the base 110 as shown in FIG. 11. The security element of the embodiment illustrated in FIGS. 9A, and 9B is shown as element 430.

In addition to or instead of the security element, the security device may include other wireless devices. For example, the security device may include an active or passive RFID tag. The RFID tag may be used to store and/or communicate information about the object for security or inventory control purposes.

The security device may also be configured with other security or alarm features. For example, the security device may have a visual alert that may be triggered in response to one or more circumstances. The visual alert may include a printed circuit board, a light-emitting diode (LED), and a battery. The LED may in electrical communication with the printed circuit board and the battery and may be configured such that at least a portion of the LED is visible through or outside of the housing. The LED may be used as an indicator (e.g., by providing a constant light or a blinking on/off light) of the existence of a particular condition or circumstance, e.g., security device has power, the capture member is in the capture position, an article of merchandise is secured within the security device, the alarm is armed, or that the alarm has been triggered. An audio alarm, such as a piezo-electric siren, may be incorporated into the printed circuit board to provide an audible alert that may be triggered by any of the aforementioned circumstances for which store personnel may require notification.

As another example, the trigger may be configured to excite and, thus, activate the alarm depending on the location of the security element to the gates of the security system. In one embodiment, the trigger may be configured to activate the alarm once the security element is near, at, or beyond the gate which should help the employees to detect the merchandise with the attached security device. Therefore, in some embodiments, the security device may have three alarm features, e.g., the gates themselves alarming when the security element is detected, the audible alarm of the security device itself triggering when the security device is compromised or otherwise tampered with, and the audible alarm of the security device triggering when the security element is at, near, or beyond the security gates.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A security device structured for attachment to an object, the security device comprising:

a base defining an aperture configured for receiving at least a portion of the object;

a capture member supported by the base, the capture member configured to move relative to the base between a capture position and a release position;

a resilient member configured to bias the capture member toward the release position wherein the resilient member is configured to engage the capture member and extend at least partially around a curvature of the aperture of the base; and a driving member supported by the base;

wherein the driving member is configured to move from a first position to a second position, wherein the driving member is configured to translate along a first direction via slidable engagement with the base while moving from the first position to the second position, the moving of the driving member from the first position to the second position causing slidable engagement between the driving member and the capture member to urge the capture member to be translated linearly in a second direction from the release position to the capture position when the driving member is moved from the first position to the second position, wherein the first direction and the second direction are different, and wherein the capture member is configured to secure the object within the aperture when the capture member is in the capture position.

2. A security device according to claim 1, further comprising a locking member configured to releasably engage the driving member and prevent movement of the driving member from the second position to the first position when the locking member is engaged with the driving member.

3. A security device according to claim 2, wherein the locking member is a locking spring configured to engage a locking surface of the driving member.

4. A security device according to claim 3, wherein the locking spring is configured to disengage the locking surface of the driving member when a magnetic key is applied to the locking spring.

5. A security device according to claim 1, wherein the security device is configured to receive a top portion of the object through the aperture when the capture member is in the release position.

6. A security device according to claim 5, wherein the capture member is configured to prevent removal of the top portion of the object from the security device when the capture member is in the capture position.

7. A security device according to claim 1, further comprising a security element.

8. A security device according to claim 7, wherein the security element is configured to be in either an active state or an inactive state, wherein the security element is in the active state when the capture member is in the capture position, and wherein the security element is in the inactive state when the capture member is in the release position.

9. A security device according to claim 1, wherein the driving member is biased in the first position.

10. The security device of claim 1, further comprising a housing attached to the base and supporting the driving member.

11. The security device of claim 1, wherein the resilient member is configured to deflect around the curvature of the aperture in response to the capture member being advanced toward the capture position, and wherein the resilient member is configured to bias the capture member toward the release position in response to being deflected around the curvature of the aperture.

12. The security device of claim 1, wherein the first direction and the second direction are substantially perpendicular to each other.

13. A security device structured for attachment to an object, the security device comprising:

a base defining an aperture configured for receiving at least a portion of the object;

a capture member supported by the base, wherein the capture member is configured to move relative to the base between a release position and a capture position, wherein the capture member is configured to secure the object within the aperture when the capture member is in the capture position;

a resilient member configured to bias the capture member toward the release position wherein the resilient member is configured to engage the capture member and extend at least partially around a curvature of the aperture of the base;

a driving member configured to translate along a first direction via slidable engagement with the base while moving from a first position to a second position, the moving of the driving member from the first position to the second position causing slidable engagement between the driving member and the capture member to urge the capture member to be translated linearly in a second direction from the release position to the capture position, wherein the first direction and the second direction are different; and a locking member configured to releasably engage the driving member and prevent the driving member from causing movement of the capture member from the capture position to the release position when the locking member is engaged with the driving member.

14. A security device according to claim 13, wherein the locking member is a locking spring configured to engage a locking surface of the driving member.

15. A security device according to claim 14, wherein the locking spring is configured to disengage the locking surface of the driving member when a magnetic key is applied to the locking spring.

16. A security device according to claim 13, wherein the security device is configured to receive a top portion of the object through the aperture when the capture member is in the release position.

17. A security device according to claim 16, wherein the capture member is configured to prevent removal of the top portion of the object from the security device when the capture member is in the capture position.

18. A security device according to claim 13, further comprising a security element.

19. A security device according to claim 18, wherein the security element is configured to be in either an active state or an inactive state, wherein the security element is in the active state when the capture member is in the capture position, and wherein the security element is in the inactive state when the capture member is in the release position.

20. The security device of claim 13, wherein the resilient member is configured to deflect around the curvature of the aperture in response to the capture member being advanced toward the capture position, and wherein the resilient member is configured to bias the capture member toward the release position in response to being deflected around the curvature of the aperture.

21. The security device of claim 13, wherein the first direction and the second direction are substantially perpendicular to each other.

* * * * *